US010018435B2

(12) United States Patent
Parker et al.

(10) Patent No.: US 10,018,435 B2
(45) Date of Patent: Jul. 10, 2018

(54) MAGAZINE WITH IMPROVED LOADING ASSEMBLY

(71) Applicant: PT MAGZ, LLC, Mundelein, IL (US)

(72) Inventors: Robert Parker, Mundelein, IL (US); Michael Parker, Mundelein, IL (US)

(73) Assignee: PT MAGZ, LLC, Mundelein, IL (US)

( * ) Notice: Subject to any disclaimer, the term of this patent is extended or adjusted under 35 U.S.C. 154(b) by 0 days.

(21) Appl. No.: 15/668,435

(22) Filed: Aug. 3, 2017

(65) Prior Publication Data

US 2018/0010872 A1 Jan. 11, 2018

Related U.S. Application Data

(63) Continuation-in-part of application No. 15/225,975, filed on Aug. 2, 2016, now Pat. No. 9,752,838.

(60) Provisional application No. 62/279,084, filed on Jan. 15, 2016.

(51) Int. Cl.
*F41A 9/67* (2006.01)
*F41A 9/69* (2006.01)

(52) U.S. Cl.
CPC .. *F41A 9/67* (2013.01); *F41A 9/69* (2013.01)

(58) Field of Classification Search
CPC ..... F41A 9/69; F41A 9/67
USPC ..... 42/50, 6, 7, 49.01, 49.02, 87; 89/33.5
See application file for complete search history.

(56) References Cited

U.S. PATENT DOCUMENTS 1,500,580 A * 7/1924 Fererro ..... F41A 9/67 42/50
2,910,795 A * 11/1959 Agren ..... F41A 9/67 206/3
3,736,686 A * 6/1973 Moller ..... F41A 9/83 42/6
3,789,531 A * 2/1974 Kersten ..... F41A 9/65 206/3
4,037,344 A * 7/1977 Reed ..... F41A 9/58 42/16
4,430,821 A * 2/1984 Vincent ..... F41A 9/67 42/50
5,309,660 A * 5/1994 Blackamore ..... F42B 33/14 42/106
6,874,618 B1 * 4/2005 Cragg ..... F42B 39/02 206/3
7,200,964 B2 * 4/2007 Gates ..... F41A 9/67 42/49.01
8,468,730 B2 * 6/2013 Faifer ..... F41A 9/67 42/50
8,650,792 B1 * 2/2014 Overmars ..... F41A 9/83 42/87
8,726,561 B1 * 5/2014 Hampton ..... F41A 9/65 42/106
8,887,428 B1 * 11/2014 Lemoine ..... F41A 9/61 42/49.01
9,010,005 B2 * 4/2015 Faifer ..... F41A 9/65 42/49.01
9,103,614 B2 * 8/2015 Froehle ..... F41A 9/67
9,121,652 B1 * 9/2015 Mangiameli ..... F41A 9/67
9,303,934 B1 * 4/2016 Kazsuk ..... F41A 9/83
9,459,063 B1 * 10/2016 Gatturna ..... F41A 9/67
(Continued)

*Primary Examiner* — John Cooper

(57) ABSTRACT

A magazine loading assembly consists of telescoping segments that pull down a magazine spring plate, but leave the magazine follower in place, to release the spring pressure and allow for ease in loading.

9 Claims, 8 Drawing Sheets

(56) References Cited

U.S. PATENT DOCUMENTS

| | | | | |
|---|---|---|---|---|
| 2007/0157501 | A1* | 7/2007 | Cammenga | F41A 9/67<br>42/87 |
| 2009/0094875 | A1* | 4/2009 | Kim | F41A 9/62<br>42/1.02 |
| 2011/0030259 | A1* | 2/2011 | Castro | F41A 9/67<br>42/6 |
| 2012/0030987 | A1* | 2/2012 | Lee, III | F41A 9/67<br>42/87 |
| 2014/0283427 | A1* | 9/2014 | Castro | F41A 9/67<br>42/49.01 |
| 2014/0373421 | A1* | 12/2014 | Hatch | F41A 9/83<br>42/87 |
| 2015/0075052 | A1* | 3/2015 | Boyarkin | F41A 9/67<br>42/87 |
| 2015/0316341 | A1* | 11/2015 | Aguilar | F41A 9/83<br>42/87 |
| 2015/0377573 | A1* | 12/2015 | Niccum | F41A 9/83<br>42/87 |

* cited by examiner

MAGAZINE WITH IMPROVED LOADING ASSEMBLY

CROSS-REFERENCE TO RELATED APPLICATION

This application claims the benefit of U.S. Provisional Patent Application No. 62/279,084 filed Jan. 15, 2016, and U.S. Non-Provisional patent application Ser. No. 15/225,975 filed Aug. 2, 2016, both of which are hereby incorporated by reference in their entirety herein.

BACKGROUND OF THE INVENTION

I. Field of the Invention

The present disclosure relates generally to cartridge magazines for firearms, and more specifically to an easy-load ammunition magazine or clip for use in magazine fed firearms.

II. Description of the Prior Art

Conventional firearm cartridge clips require that the ammunition shells be manually loaded one at a time through an upper opening into the magazine overcoming the progressively increasing resistance of a magazine spring. In general, each shell, as it is being loaded, is pressed against a previously loaded shell requiring considerable finger dexterity and strength. Indeed, this loading operation requires increasing force as more rounds of ammunition are loaded into the magazine and the magazine spring is progressively compressed. This loading operation thus requires the firearm user to apply progressively increasing loading forces with their finger, which in turn progressively increases the fatigue on the finger, which in turn may cause pain and possible injury.

Accordingly, many people do not have the prerequisite finger strength or dexterity to manually load a firearm cartridge clip. Others are only able to partially load the clip, as the dexterity and strength required to fully load the clip exceeds their capabilities.

Furthermore, even those who are able to load the magazine to its full capacity are typically unable to load the last several ammunition rounds as quickly as the first several ammunition rounds were loaded. Indeed, resistance of the clip spring can slow the speed with which a clip is loaded, as well as tire an individual that has to load multiple clips.

A plethora of attempts have been made to provide clips or devices to be used with clips to facilitate the loading of the ammunition shells into the magazine. Most of these attempts focus on drawing down the clip spring and follower, in one form or another, to reduce the loading resistance. Some of these designs have proven to be overly complex while others simply do not work for their intended purpose. The overly complex designs tend to be rather cumbersome and time consuming. And, the simpler designs increase the likelihood that the ammunition shells will fall into the clip in the vertical or diagonal orientation, requiring that the clip be emptied and reloaded. As such, there is currently nothing available to the firearm user that adequately addresses the aforementioned problems.

The present disclosure overcomes the problems associated with the loading of ammunition into conventional magazine clips. Accordingly, it is a general object of this disclosure to provide an improved magazine loading assembly for automatic and semi-automatic firearms.

It is another general object of the present disclosure to provide a magazine loading assembly that releases spring pressure to enable ease and efficiency of loading ammunition.

It is a more specific object of the present disclosure to provide a magazine loading assembly follower that maintains appropriate resistance, without spring pressure, to enable proper alignment and positioning of loaded ammunition.

It is another more specific object of the present disclosure to provide a self-contained telescoping assembly within the magazine for releasing clip spring pressure.

These and other objects, features and advantages of this disclosure will be clearly understood through a consideration of the following detailed description.

SUMMARY OF THE INVENTION

According to an embodiment of the present disclosure, there is provided a firearm magazine loading assembly having a housing, a telescoping assembly within the housing including a bottom end and a plurality of tubing segments having smaller top ends and larger bottom ends such that each smaller segment fits within an adjacent segment wherein the bottom segment extends through the bottom of the housing. A magazine spring within the housing is biased against the spring plate at one end and against housing bottom at the other. A follower is positioned within the housing between the open top end and the spring plate whereby when the telescoping assembly is in a retracted and firing mode the spring urges the follower against a flange on the top end of the housing and when the telescoping assembly is in an extended and loading mode the spring does not urge the follower.

According to another embodiment of the present disclosure, there is provided a firearm magazine loading assembly having a housing, a telescoping assembly within the housing including a bottom end with a handle and a plurality of tubing segments having smaller top ends and larger bottom ends such that each smaller segment fits within an adjacent segment wherein the bottom segment extends through the bottom of the housing. A spring plate having front and rear legs for aligning a spring. A magazine spring within the housing is biased against the spring plate at one end and against housing bottom at the other. A follower having an angled front leg and a back leg including resistive bars is positioned within the housing between the open top end and the spring plate whereby when the telescoping assembly is in a retracted and firing mode the spring urges the follower against a flange on the top end of the housing and when the telescoping assembly is in an extended and loading mode the spring does not urge the follower.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

One or more embodiments of the subject disclosure will now be described with the aid of numerous drawings. Unless otherwise indicated, use of specific terms will be understood to include multiple versions and forms thereof.

Figure 1:
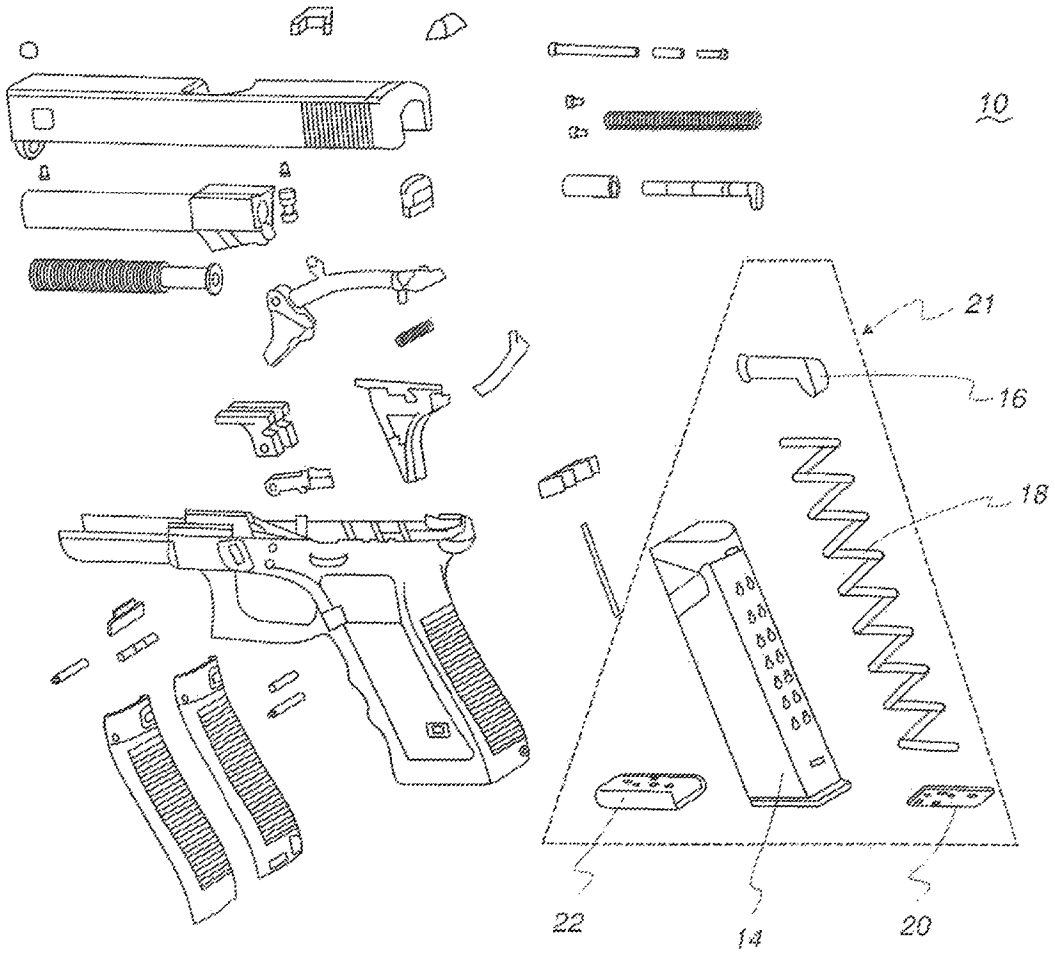
Fig. 1 (Prior Art)
FIG. 1 is an exploded view of the component parts of a conventional prior art semi-automatic pistol.
Figure 2A:
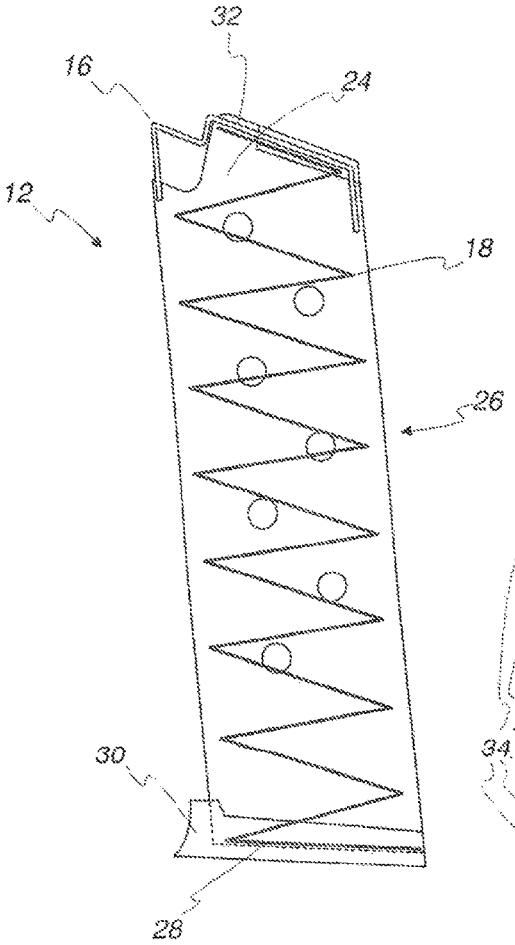
Fig. 2a (Prior Art)
FIG. 2*a* is a cross-sectional is the side view of a conventional prior art gun magazine without ammunition rounds loaded.
Figure 2B:
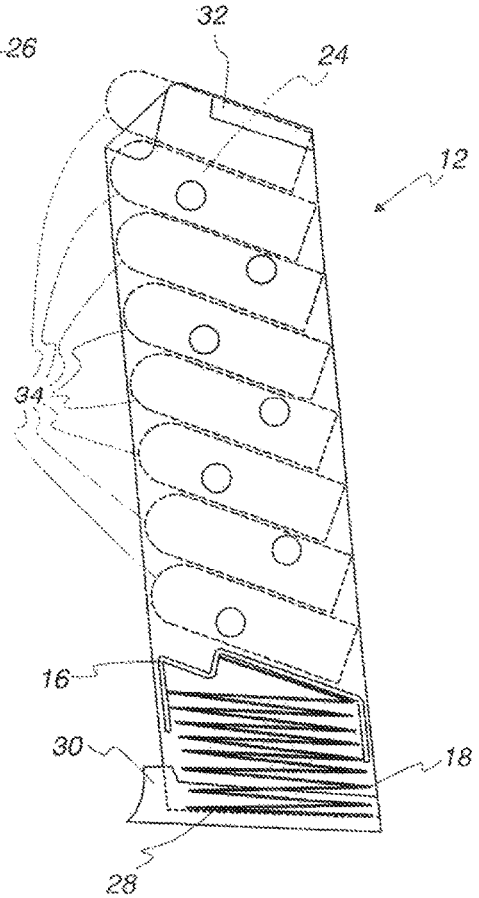
Fig. 2b (Prior Art)
FIG. 2*b* is the diagram of FIG. 2*a* with ammunition rounds loaded.

In any event, turning now to the Figures, and in particular FIG. 1, the component parts 10 of a conventional prior art semi-automatic pistol are shown. Specific to the present disclosure are the parts of the magazine assembly 12 including the magazine tube 14, the follower 16, the magazine spring 18, the magazine insert 20 and the magazine floorplate 22. Such a magazine assembly 12 is also illustrated in FIGS. 2*a* and 2*b*. FIG. 2*a* illustrates magazine spring 18 and magazine follower 16, which are located inside cavity (or chamber) 24 of the magazine frame 26. The upper end of the spring element 18 engages the underside of magazine follower 16, and the lower end of spring element 18 engages magazine base 28 (which is held in place by magazine end cap 30). Spring element 18 typically has a coiled (spiral) configuration within cavity 24.

Spring element 18 is under compression such that magazine follower 16 is forced upward into contact with flange 32. A shell is manually loaded into gun magazine 12 by pressing the cylindrical shaped sidewall of the shell down onto magazine follower 16. The shell and magazine follower 16 are moved downward against the force induced by spring element 18 until the shell is located substantially within cavity 24 and a gap exists between the upper surface of the shell and the lower surfaces of flanges 32. The shell is slid back into the gap while maintaining downward pressure on the shell. The downward pressure on the shell may be released such that the spring element 18 forces magazine follower 16 and the shell upward, thereby forcing the shell into engagement with flange 32. The next shell is manually loaded on top of the first shell in the same manner.

FIG. 2*b* illustrates eight shells 34 of ammunition loaded in gun magazine 12. As illustrated, spring element 18 is forced into a state of high compression by shells 24. The conventional method for loading gun magazine 12 is both difficult and time consuming. A person loading gun magazine 12 will typically experience tired and/or cramped fingers after repeated loading operations.

Indeed, some people find it difficult to manually load a firearm magazine due to the bias necessary within the magazine to keep the ammunition rounds in correct alignment both prior and after positioning within the firing chamber. The bias typically increases as more rounds are loaded into the magazine clip.

Accordingly, the present disclosure was conceived to eliminate this long existing difficulty of loading rounds into a magazine. In particular, the self contained unit relieves the spring pressure in the magazine and allows the rounds to be effectively loaded in the proper alignment. This assembly has been designed in a cost effective manner and can be incorporated into any magazine regardless of caliber or capacity for automatic and semi-automatic pistols and rifles.

Figure 3A:
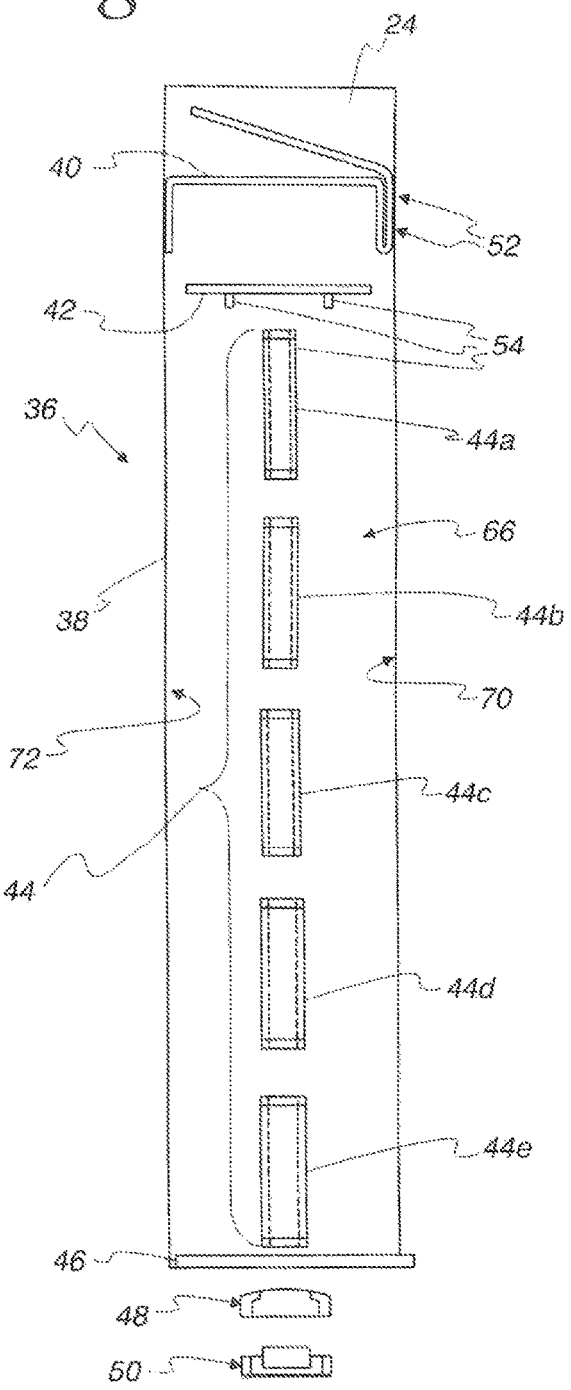
FIG. 3*a* is a cross-sectional side view of the magazine loading assembly according to the principles of an embodiment of the present disclosure.
Figure 3B:
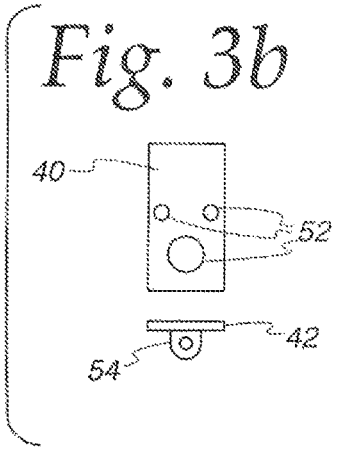
FIG. 3*b* is a rear view of the follower and spring plate components of FIG. 3*a*.

An embodiment of the present disclosure will now be illustrated through the remaining Figures. It will be understood that many of the main parts of a typical magazine (as shown in FIGS. 1-2*b*) remain. In any event, turning first to FIGS. 3*a* and 3*b*, the main magazine loading assembly 36 is shown, save for the spring element (shown later) to aid in the illustration. Inside the magazine assembly frame (or housing) 38 is the magazine follower (or cartridge support seat) 40, the magazine spring plate 42, the magazine telescoping assembly 44, the magazine floor plate 46. The telescoping assembly holder (or perhaps magnet) 48 and handle 50 are positioned outside of the magazine assembly frame 38. FIG. 3*b* illustrates both the spring detents 52 on the back plate of the follower 40 as well as the wire guide holes 54 on the underside of the spring plate 42 and the end of the first length of telescoping assembly 44.

The telescoping assembly comprises a number of segments (dependent upon magazine length) of tubing that are crimped smaller on one end and extruded larger on the other end such that each smaller segment fits within its adjacent segment. For example, segment 44*a* fits within segment 44*b*, which fits within segment 44*c*, which fits within segment 44*d* which then fits within segment 44*e*. The top end of the first segment 44*a* is coupled to the magazine spring plate 42 via wire (not shown) and wire guide holes 54. The bottom end of the last segment 44*e* is user graspable and may be coupled to holder 48 which in turn is coupled to handle 50. The magazine spring 56 (shown in FIGS. 4 and 5) may be simply biased against the spring plate and floor plate and/or may also be coupled on one end to the spring plate via guide holes 54 via crimping or welded and then similarly coupled to the top of the floor plate 46. While the magazine spring 56 of the disclosure may be a custom spring and accordingly customly attached, it may also be of conventional design and therefore affixed (or simply biased against) in any conventional manner.

Figure 4:
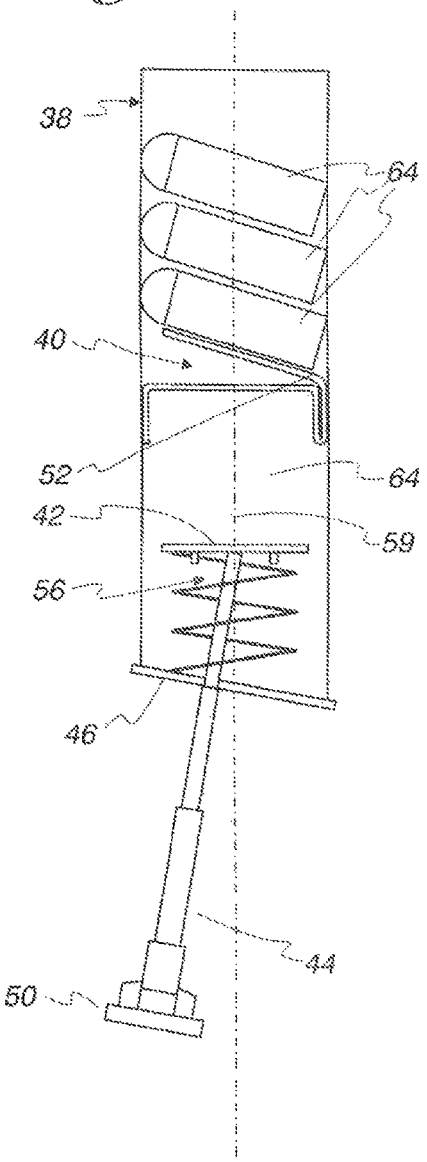
FIG. 4 is a cross-sectional side view of the magazine loading assembly of FIG. 3*a* in the locked and loading mode position.
Figure 6:
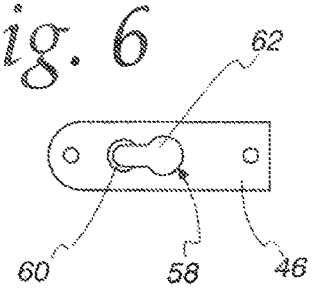
FIG. 6 is a bottom view of the floor plate component of FIG. 3*a*.

During the loading procedure, and turning now to FIGS. 4 and 6, the handle 50 is pulled down and the telescoping assembly 44 is positioned away from the telescoping assembly hole 58 of the floor plate 46, and off of the central axis 59 of the housing 38, and into the locking hole 60. These holes together comprise a coined keyhole 62. This releases the spring pressure and readies the magazine for loading. While the spring plate 42 is pulled down the assembly frame 38, the follower 40 remains positioned and aligned within the frame due to the frictional forces of the spring detents 52 against the inside wall of the frame 38. In other words, the follower 40 does not fall when the spring 56 is compressed. This is due to the fact that the follower 40 and the unique spring plate 42 are separate component parts and not otherwise coupled together. Indeed, there is no spring plate 42 in conventional magazines. As such, when the telescoping assembly 44 is pulled down and locked into the keyhole 62, there is space 64 between the follower 40 and the spring plate 42. As each round 66 of ammunition is loaded, this space 64 narrows, but remains aligned along the central axis 59 via detents 52, until the user has completed loading.

Figure 5:
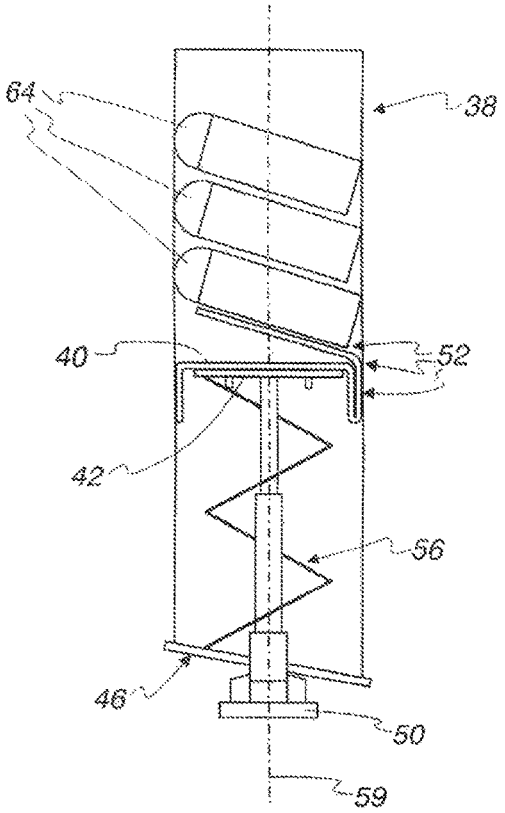
FIG. 5 is a cross-sectional side view of the magazine loading assembly of FIG. 3*a* in the retracted and ready for use firing mode position.

Once loading is complete, and referring now to FIG. 5, the telescoping assembly is unlocked from the keyhole 62, positioned along the central axis 59, retracted together, and the handle 50 is fastened to the bottom of the floor plate 46. The spring 56 then pushes the spring plate 42 against the follower 40 with the correct amount of pressure, and the magazine is ready to be inserted into the firearm and used.

Figure 7:
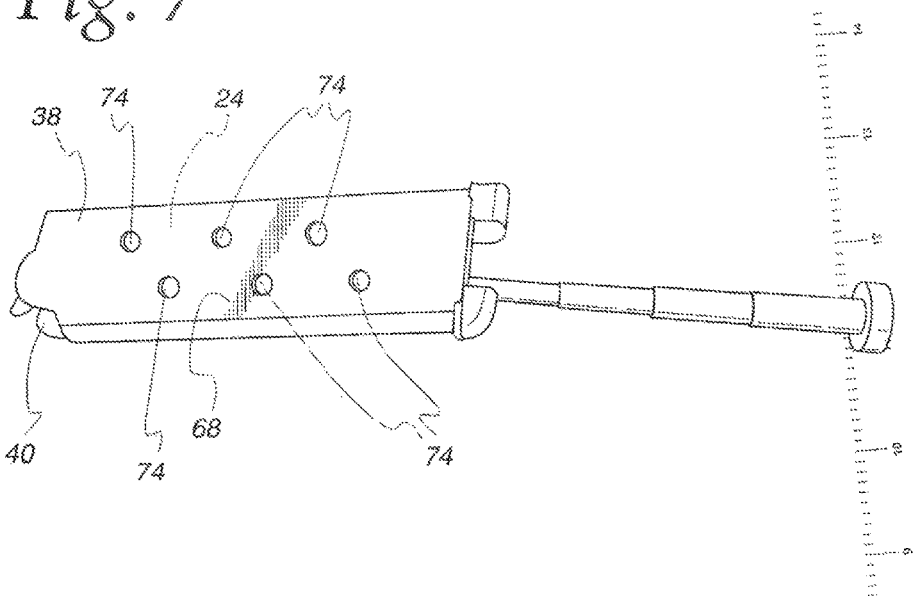
FIG. 7 is a side view of the magazine loading assembly in the locked and loaded position according to the principles of an embodiment of the present disclosure.
Figure 8:
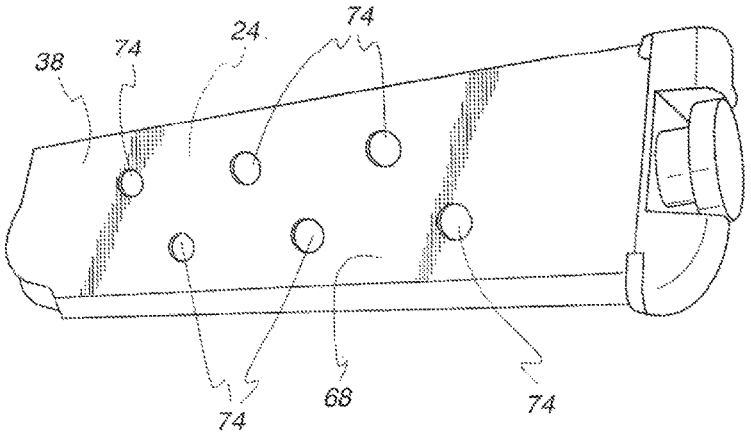
FIG. 8 is a side view of the assembly of FIG. 7 in the retracted position loaded with rounds of ammunition.

Turning now to FIGS. 7 and 8, the magazine assembly frame 38 is typically a metal structure that includes a cavity 24, which is dimensioned to closely receive a plurality of cartridges. As known to those of ordinary skill, a cartridge typically includes a bullet (or slug), a casing, and gunpowder. The cavity 24 is defined by a right side wall 66, a left sidewall 68, a back wall 70, rounded front wall 72 and a magazine base or floor plate 46. That said, in the loading mode of FIG. 7, the telescoping assembly 44 is pulled out and locked in place within the keyhole. While the spring plate has been pulled down, the follower 40 remains in place and ready to receive cartridges. The round counting apertures 74 reveal only space 64 in the cavity 24 between the follower 40 and the floorplate. When the magazine has been loaded and is in the firing mode of FIG. 8, the telescoping assembly 44 is retracted and fastened to the base. The round counting apertures 74 reveal no space between the follower 40 and the floorplate and the cartridge now has the correct spring pressure to be fired from the firearm.

It will be understood and appreciated that while the present disclosure has been shown and described as a single stack pistol magazine, the disclosure is in no way limited thereto. Indeed, this subject magazine loading assembly is also ideal for multiple stacks and any make and caliber. Additionally, while the telescoping segments were described as temper stainless steel surgical tubes, machined stainless segments or plastic may be used. Similarly, the follower may be made of plastic with dimples (detents) or leaf springs or any other element to obtain the correct amount of frictional resistance.

One alternate embodiment of the magazine assembly frame 38 is to taper one or more of the walls inward as they progress towards the floor plate 46. This may be beneficial in a double stack magazine when the weight of the rounds may cause the follower to fall too freely. A tapered chamber would allow for the correct resistance for the entire length of rounds without decreasing the main spring to push the rounds up to the firearm feed lips.

Figure 9A:
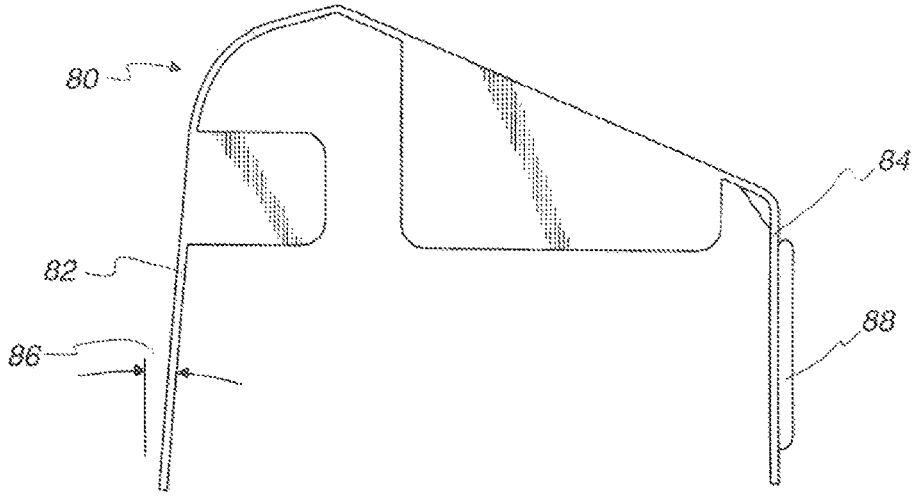
FIG. 9*a* is an enlarged side view of the follower component according to another embodiment of the present disclosure.
Figure 9B:
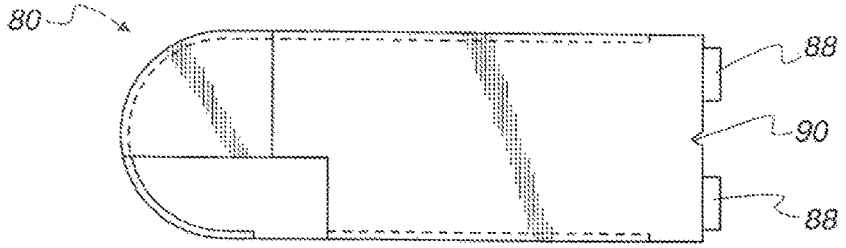
FIG. 9*b* is an enlarged top view of the follower of FIG. 9*a*.
Figure 9C:
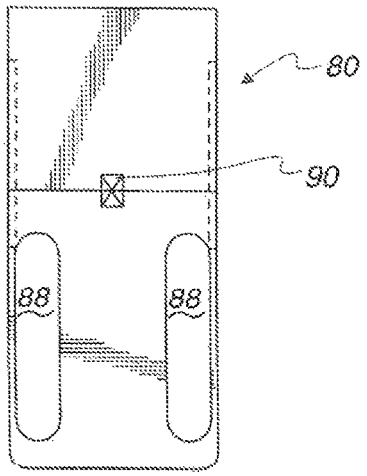
FIG. 9*c* is an enlarged rear view of the follower of FIG. 9*a*.

One alternate embodiment of the follower component of the magazine assembly is shown in FIGS. 9*a*-9*c*. In particular, the follower 80 includes a front leg 82 and a rear leg 84. The front leg 82 is angled 86 relative the vertical such that when the follower 80 is positioned within the chamber 24 it keeps rounds aligned and maintains a bias against the front wall 72. The back leg 84 includes one or more resistance bars 88 to aid in follower 80 alignment within the chamber 24 as well as resistance against the back wall 70. A gusset 90 provides rigidity and strengthens the back leg 84. This follower embodiment provides for an optimal amount of resistance to maintain correct orientation of ammunition.

Figure 10B:
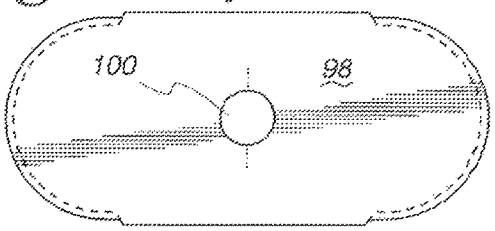
FIG. 10*b* is an enlarged top view of the spring plate of FIG. 10*a*.
Figure 10A:
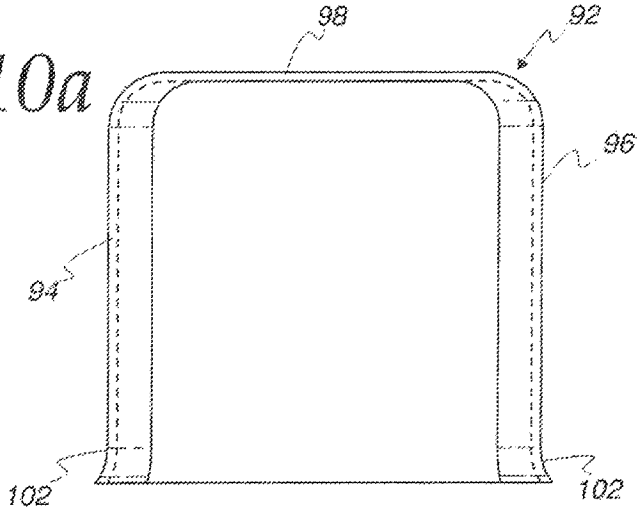
FIG. 10*a* is an enlarged side view of the spring plate component according to another embodiment of the present disclosure.

One alternate component of the spring plate component of the magazine assembly is shown in FIGS. 10*a* and 10*b*. In particular, the spring plate 92 includes a front leg 94 and a rear leg 96. The top 98 of the spring plate 92 includes an aperture (hole) 100 to attach the telescope tubing. Each leg is flared 102 to better lead in the coiled spring and long enough to contact the floor plate 46 and level the spring plate 92 during loading. The elongated legs contain the spring with all coils in alignment and correct size when fully collapsed. The spring is essentially immobilized and unable to move from one side or the other of the chamber. Accordingly, when loading, the follower 80 does not hit the spring and does not increase difficulty of final round loading. The follower is positioned over and around the spring plate and there is no interference of any rounds of ammunition.

Figure 11:
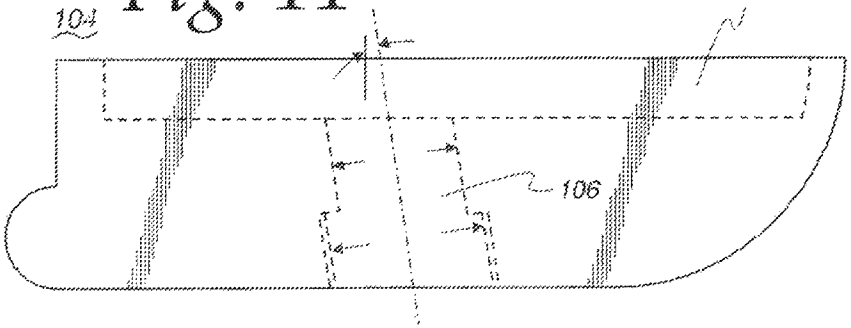
FIG. 11 is an enlarged side view of the handle component according to another embodiment of the present disclosure.

One alternate component of the handle component of the magazine assembly is shown in FIG. 11. In particular, the handle 104 is coupled to the bottom end of the last telescoping segment. This may be accomplished via cavity 106 engagement or otherwise. As such, when the handle 104 is pulled it extends the telescoping unit down to enable locking within the floor plate 46 for round loading. When the magazine is loaded, the handle is recessed with a cavity 108 and lightly snaps onto the floor plate to keep it in place. The handle also acts as a bump plate to push the magazine into the firearm.

Figure 12:
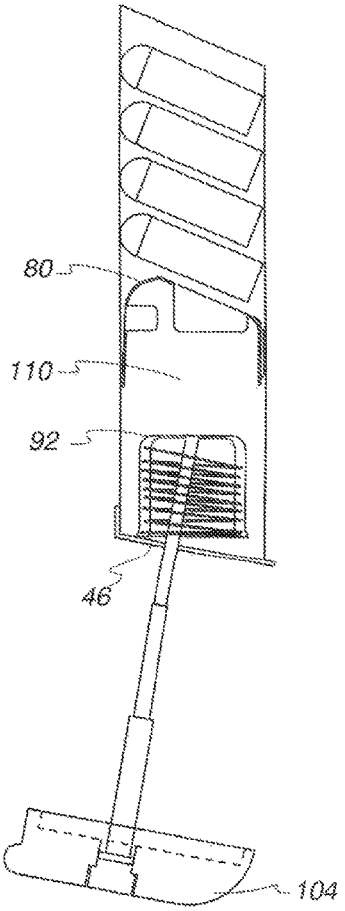
FIG. 12 is a cross-sectional side view of a magazine loading assembly in the locked and loading mode position according to another embodiment of the present disclosure.
Figure 13:
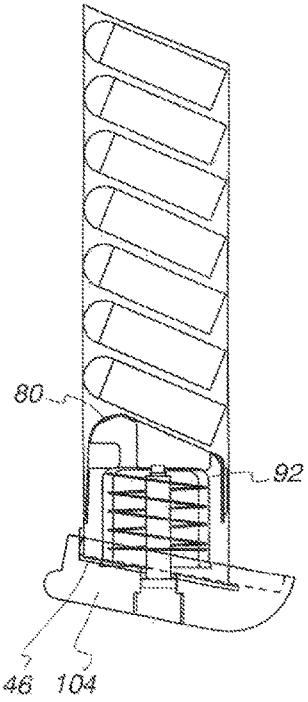
FIG. 13 is a cross-sectional side view of the magazine loading assembly of FIG. 12 in the loaded mode position.
Figure 14:
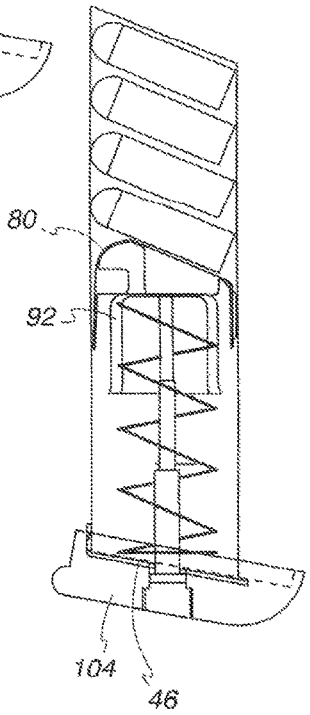
FIG. 14 is a cross-sectional side view of the magazine loading assembly of FIG. 12 in the operating position.

The alternate component parts will now be shown incorporated within a magazine during loading, loaded and operating positions, FIGS. 12-14 respectively. During the loading procedure of FIG. 12, the handle 104 is pulled down and the telescoping assembly 44 is positioned away from the telescoping assembly hole and into the locking hole of the floor plate as described in FIGS. 4 and 6. This releases the spring pressure and readies the magazine for loading. While the spring plate 92 is pulled down, the follower 80 remains positioned and aligned within the frame due to the frictional forces of both the front leg 82 and the resistance bars 88 on the back leg. The spring plate 92 houses and aligns the spring between the spring plate legs as well as the top of the spring plate and the floor plate 46. As before, when the telescoping assembly is pulled down and locked, there exists space 110 between the follower 80 and the spring plate 92. As each round of ammunition is loaded, this space 110 narrows, but remains aligned until loading is complete.

Once loading is complete, and referring now to FIG. 13, the telescoping assembly is unlocked and the handle 104 is snapped into position about the floor plate. The spring then pushes the spring plate 92 against the follower 80 with the correct amount of pressure, and the magazine is ready to be inserted into the firearm and used. In use, as shown in FIG. 14, when a round is fired the spring plate 92 pushes up the follower 80 as well as the telescoping tubes and feeds the next round.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. A firearm magazine loading assembly comprising:

a housing dimensioned for a stack of ammunition, said housing including a bottom, a front wall, a back wall, and two side walls, said housing further including an open top end with a flange;

said bottom comprising a floor plate having a main aperture;

a telescoping assembly within said housing having a plurality of tubing segments having smaller top ends and larger bottom ends such that each smaller segment fits within an adjacent larger segment and wherein the bottom end of the bottom segment extends through said aperture and is coupled to a handle having a cavity for coupling said floor plate, said handle positioned outside of said housing and the top end of the top segment is coupled to a spring plate within said housing;

a magazine spring within said housing having one end biased against said floor plate and another end biased against said spring plate;

said spring plate having elongated front and rear legs for aligning said spring; and a follower having a front leg and a rear leg, said follower positioned within said housing between said open end of said housing top and said spring plate whereby when said telescoping assembly is in a retracted and firing state said spring urges said follower against said flange and when said telescoping assembly is in an extended and loading state said spring does not urge said follower against said flange.

2. The assembly as defined in claim 1 wherein said floor plate includes a smaller aperture adjacent said main aperture for locking said telescoping assembly into said loading state.

3. The assembly as defined in claim 2 wherein said apertures form a coined keyhole.

4. The assembly as defined in claim 1 wherein said follower includes one or more bars frictionally engaging one or more of said walls of said housing.

5. The assembly as defined in claim 1 wherein said housing is dimensioned for a multiple stack of ammunition.

6. The assembly as defined in claim 1 wherein said follower includes a front leg and a rear leg whereby at least one of said legs is angled to maintain a bias against a wall of said housing.

7. The assembly as defined in claim 1 wherein said follower includes a gusset.

8. The assembly as defined in claim 1 wherein said spring plate includes elongated front and rear legs for aligning said spring.

9. The assembly as defined in claim 1 wherein said handle includes a cavity for receiving said floor plate.

* * * * *